United States Patent [19]

Pretty

[11] 3,935,778

[45] Feb. 3, 1976

[54] APPARATUS FOR ACTUATING A PLURALITY OF PISTON AND CYLINDER ASSEMBLIES

[75] Inventor: Frederick A. Pretty, Alveston, England

[73] Assignee: USM Corporation, Boston, Mass.

[22] Filed: July 5, 1974

[21] Appl. No.: 485,886

[30] Foreign Application Priority Data

July 10, 1973 United Kingdom ..... 32804/73

[52] U.S. Cl. ..... 83/639; 100/258 A; 100/270

[51] Int. Cl.[2] ..... B26D 5/12; B30B 1/08

[58] Field of Search .. 83/639; 100/270, 271, 258 A, 100/272

[56] References Cited

UNITED STATES PATENTS

| | | | |
|---|---|---|---|
| 2,224,968 | 12/1940 | Klocke | 100/271 X |
| 3,054,317 | 9/1962 | Castle, Jr. | 83/639 X |
| 3,530,749 | 9/1970 | Röhmer | 83/639 X |
| 3,763,690 | 10/1973 | Kirincic et al. | 100/258 A X |

*Primary Examiner*—Willie G. Abercrombie

*Attorney, Agent, or Firm*—Ralph D. Gelling; Vincent A. White; Richard B. Megley

[57] ABSTRACT

The subject invention involves apparatus for simultaneously actuating a plurality of piston and cylinder assemblies which are used to drive the movable platen of a cutting press. The instant press has a platen driven by four piston and cylinder assemblies, each assembly being connected to a source of pressurized fluid through an appropriate spool valve. The spool valves are actuated simultaneously by the movement of a pair of actuator bars which are interconnected for coordinated movement through bell cranks to a single piston and cylinder drive means.

3 Claims, 3 Drawing Figures

APPARATUS FOR ACTUATING A PLURALITY OF PISTON AND CYLINDER ASSEMBLIES

BACKGROUND OF THE INVENTION

This invention is concerned with improvements in or relating to presses, especially presses comprising two platens one of which is movable relative to the other to effect an operating stroke of the press, and fluid pressure operated means comprising a plurality of piston and cylinder arrangements for effecting movement of the movable platen.

There is described in the specification of the commonly owned copending U.S. patent application Ser. No. 390,250 a press comprising two platens one of which is movable relative to the other to effect an operating stroke of the press, fluid pressure operated means comprising a plurality of piston and cylinder arrangements for effecting movement of the movable platen, a plurality of spool valves, one associated with each of the piston and cylinder arrangements, the spool of each of said valves being engageable by valve actuating means, and actuation of the spool valves being effective to admit fluid under pressure to the piston and cylinder arrangements, and drive means for moving the valve actuating means simultaneously to move the spools of said valves to admit fluid under pressure to the piston and cylinder arrangements and to maintain the spool valves in actuated condition as the movable platen moves to effect an operating stroke of the press.

In the press described in detail in said specification, the spool valves are mounted for movement with the movable platen and the drive means is effective to move the valve actuating means to engage the valve spools, thus to initiate an operating stroke of the press, and thereafter continues to move the valve actuating means to maintain the spool valves in actuated condition. The drive means of said press comprises a plurality of lead screws, driven by a single motor through connecting means having a 1:1 ratio. The valve actuating means comprises two bars extending between the spools and each arranged to engage two spools so as to operate the spools simultaneously. The motor of the drive means is a conventional hydraulic motor which operates through a reduction gear unit in order to control the speed of drive of the valve actuating means.

More specifically, in said press the lower platen is mounted for movement relative to the upper platen to effect an operating stroke of the press, the lower platen being mounted for this purpose on a plurality of, in this case four, cylinders which are movable upon admission of fluid under pressure thereto, on stationary pistons, piston rods of which are secured to the press frame. The spool valves are mounted on their associated cylinders and the spools thereof have a downwardly projecting portion arranged to be engaged by the bars constituting the valve actuating means, each bar being supported at its ends by the lead screws which are synchronously driven.

Although the use of lead screws has been shown to be effective in operation, nevertheless it has been shown to be expensive to produce a system which utilizes a hydraulic motor cooperating with such lead screws. It is one of the various objects of the present invention, therefore, to provide an improved press in which a valve actuating system is provided which is equally effective in operation as the earlier system, but which is less expensive to produce.

BRIEF DESCRIPTION OF THE INVENTION

The invention provides, as one of its several features, a press comprising two platens one of which is movable relative to the other to effect an operating stroke of the press, fluid pressure operated means comprising a plurality of piston and cylinder arrangements for effecting movement of the movable platen, a plurality of spool valves, one associated with each of the piston and cylinder arrangements, the spool of each of said valves being engageable by the valve actuating means, and actuation of the spool valve being effective to admit fluid under pressure to the piston and cylinder arrangement, and drive means for moving the valve actuating means simultaneously to move the spools of said valves to admit fluid under pressure to the piston and cylinder arrangements, and to maintain the spool valves in actuated condition as the movable platen moves to effect an operating stroke of the press, the drive means comprising a plurality of lever arrangements driven by a single motor through connecting means.

The above and other of the various objects and several features of the present invention will become clearer from the following detailed description to be read with reference to the accompanying drawings of one press which is illustrative of the invention. It will of course be realized that this illustrative press has been selected for description merely by way of exemplification of the invention and not by way of limitation thereof.

In the accompanying drawing

Figure 1:
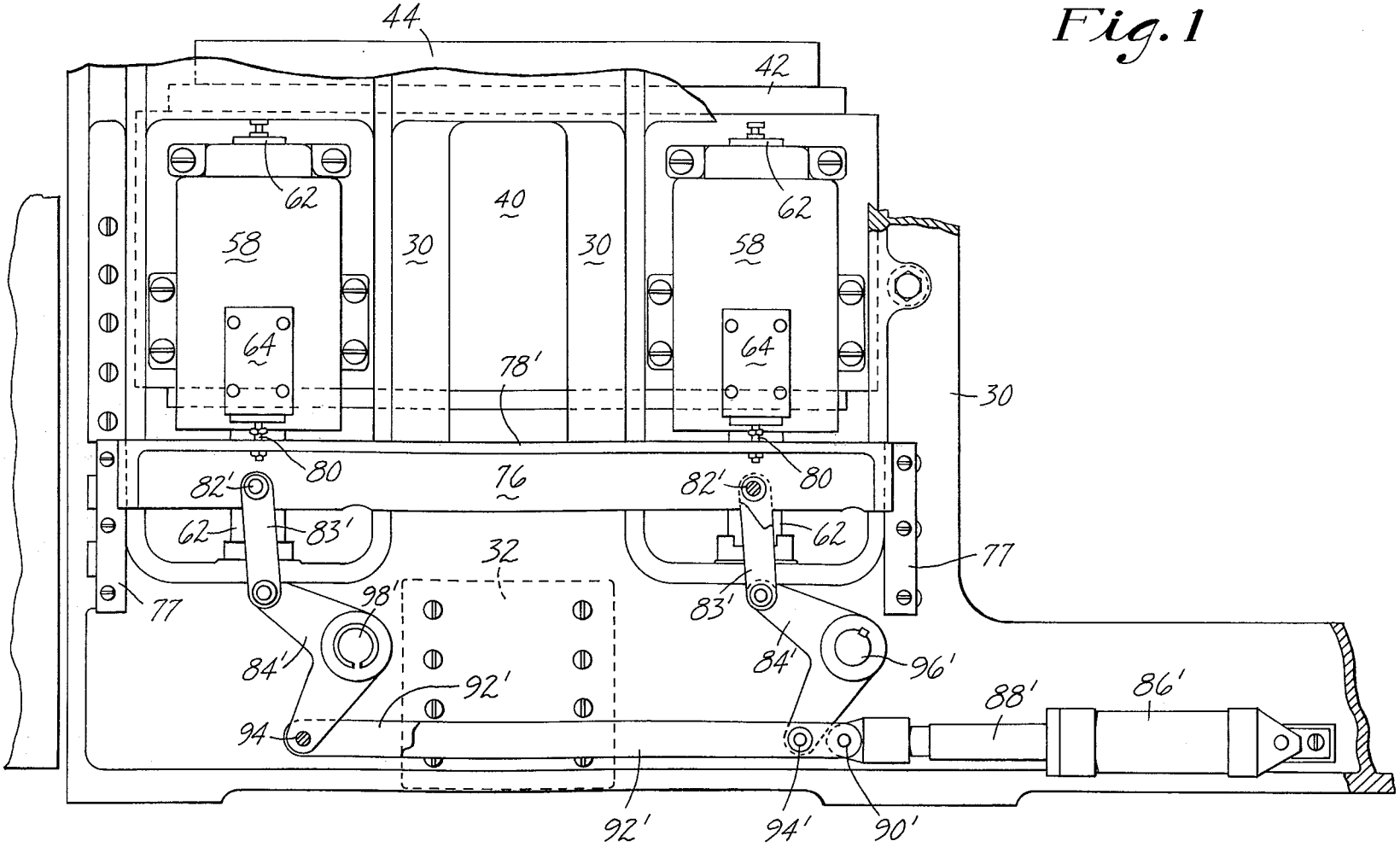
FIG. 1 is a fragmentary view, in side elevation, of the illustrative press, showing drive means and valve actuating means thereof.

The illustrative press, which is generally similar except as hereinafter described to the press described in the aforementioned specification, comprises a frame comprising side frames 30 secured together by cross members 32 and tie rods (not shown). The illustrative press also comprises a lower platen 40 in the form of a box structure having a top plate 42 on which a cutting block 44 can be supported, and an upper platen (not shown) also in the form of a box structure and provided with a lower striker plate. The lower platen is mounted for movement toward and away from the upper platen by fluid pressure operated means to effect a cutting stroke of the press. Also, the upper platen is mounted for movement between a forward position in which it is in opposed relationship with the lower platen and an out-of-the-way position. The lower platen 40 also acts as a tank for hydraulic fluid which is supplied to the fluid pressure operated means above referred to.

LOWER PLATEN: DRIVE ARRANGEMENT

The lower platen 40 is supported by means for four cylinders 58 provided with flanges by which the cylinders are bolted to side members of the lower platen. Each cylinder accommodates a piston having a piston rod 62 projecting upwardly and downwardly from its associated cylinder, the piston rods being secured at their upper and lower ends to the side frames. Thus, admission of fluid under pressure to one of the cylinders 58 is effective to cause said cylinder to move heightwise relative to its associated piston rod so that the lower platen is moved relative to the side frame. Mounted on the outside of each of the cylinders 58 is a spool valve 64 through which fluid under pressure can pass to the cylinder 58 associated therewith. Each spool valve 64 comprises a spool which is spring-urged downwardly so that a lower end portion thereof projects downwardly from the body of the valve. When the spool is in a neutral position no fluid under pressure is admitted to the cylinder. When, however, the spool is moved upwardly (see FIG. 1) or spring-urged downwardly, fluid is admitted via the valve to its associated cylinder.

For actuating the spool valves 64, the illustrative press comprises valve actuating means constituted by two actuator members 76 extending forwardly and rearwardly of the press and slidable in guideways provided by angle members 77 secured to the side frames. Each member 76 is in the form of a bar having a flange portion 78' supporting two abutment screws 80, each screw being in alignment with the spool of one of the spool valves. For moving the actuator members 76 heightwise of the illustrative press, drive means is provided comprising four lever arrangements each of which is pivotally connected, two to each of the members 76, by means of pivot pins 82'. Each lever arrangement comprises a line 83' pivotally supported on an associated pivot pin 82' and in turn pivotally connected to an arm of a bell crank lever 84'. For operating the lever arrangements, the illustrative press also comprises a hydraulic piston and cylinder arrangement 86' mounted on the righthand side frame 30, with its piston rod 88' extending forwardly of the press. Connected by means of a pivot pin 90' to the forward end of the piston rod 88' is a link member 92' to which are pivotally connected, by means of pivot pins 94', arms of the two bell crank levers 84' arranged at the right-hand side of the press. Similarly, a further link member 93' connects arms of the two bell crank levers 84' arranged at the left-hand side of the press. The two rearward bell crank levers 84' are keyed to a cross shaft 96' extending across the width of the illustrative press. The forward two bell crank levers, on the other hand, are each mounted on a stub shaft 98', each stub shaft being secured to the side frame associated therewith.

In the operation of the illustrative press, it will thus be apparent that admission of fluid under pressure to the piston and cylinder arrangement 86' will be effective to cause the rearward right-hand side bell crank lever 84' to pivot about the cross shaft 96' which, in turn, will cause the rearward left-hand side bell crank lever, also keyed to the shaft 96', to pivot synchronously therewith and furthermore, through the links 92', 93', the forward two bell crank levers will also be caused to pivot about their stub shafts 98' so that all four bell crank levers are caused to pivot through a similar distance, according to the stroke of the piston rod 88'. In this way, it will be appreciated, the two members 76 are moved upwardly and downwardly synchronously through their connections provided by pivot pins 82'.

As has been specifically described in the aforementioned specification, when a cycle of operation of the illustrative press is initiated (and the bell crank levers are caused to pivot), the actuator members 76 are raised and, through the abutment screws 80, cause the spools of the spool valves 64 also to be raised, whereby fluid under pressure is admitted to the upper end of each cylinder 58, with a result that the cylinders, and the lower platen 40 therewith, are raised to effect a cutting stroke of the press.

OPERATION

The operation of the illustrative press is generally similar, except as hereinafter described, to the operation of the press described in the aforementioned specification. Thus, upon the upper platen reaching its forward position determined by microswitch MS1 (not shown in FIG. 3), solenoid SOL4 is energized to switch solenoid valve SV45, so that a spool moves to the right (viewing FIG. 3). In this way, fluid under pressure from line 274 passing through regulator valve RV11 passes through the solenoid valve SV 45 to the right-hand end (viewing FIG. 3) of the piston and cylinder arrangement 86', while fluid under pressure from line 280 passes via regulator valve RV12 to the left-hand end (viewing FIG. 3) of said piston and cylinder arrangement. The area of the piston of said arrangement 86' is such the right-hand face of the piston has twice the area of the left-hand face so that, with fluid pressure applied to both sides of the piston, the piston moves to the left (viewing FIG. 3), so that the bell crank levers 81' are caused to rotate about their pivots to raise the actuator members 76. As the actuator members rise, the spools of the spool valves 64 are engaged by the actuator members and a cycle of operation takes place as described in the aforementioned specification.

Figure 3:
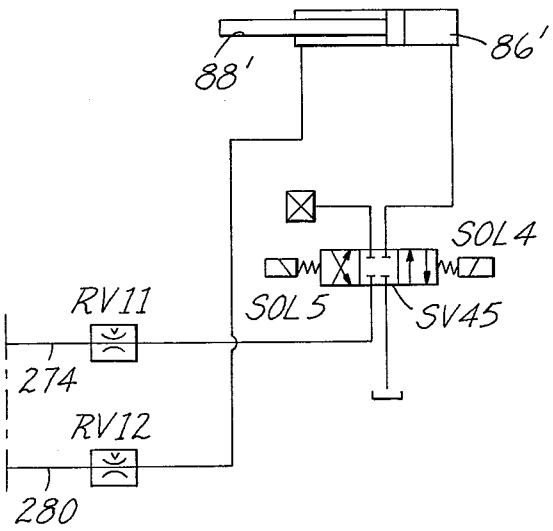
FIG. 3 is a fragmentary diagram showing part of a hydraulic circuit of the illustrative press.
Figure 2:
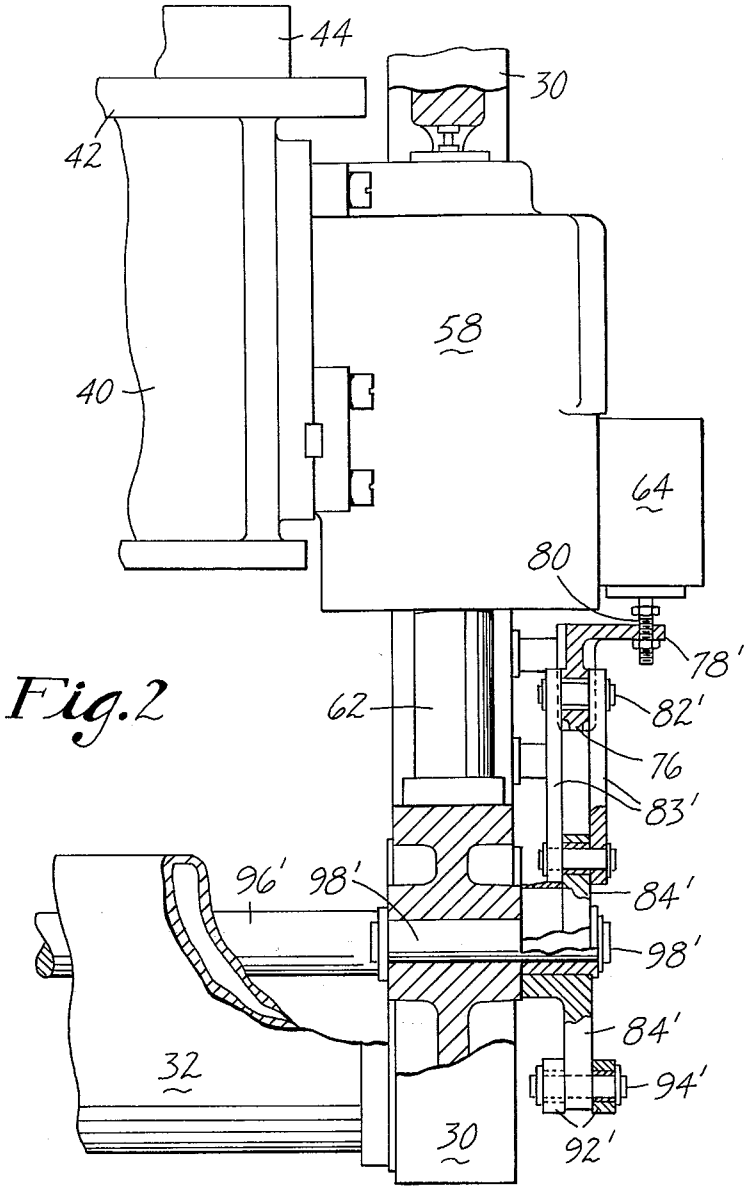
FIG. 2 is a fragmentary section view of part of the illustrative press shown in FIG. 1.

At the end of a cutting stroke of the illustrative press solenoid SOL4 is de-energized and solenoid SOL 5 is energized, thus switching solenoid SV45 and moving its spool to the left (viewing FIG. 3). Thereupon, fluid under pressure from line 274 passes through regulator valve RV11 and solenoid valve SV45 to tank while fluid under pressure continues to be applied from line 280 through regulator valve RV12 through the left-hand end of the piston and cylinder arrangement 86' so that the piston is moved to the right (viewing FIG. 3) with the result that the bell crank levers are caused to rotate in an opposite direction, moving the actuator members 76 downwardly. Such downward movement is arrested upon actuation of the microswitch MS5 (not shown) by which solenoid SOL5 is de-energized and solenoid valve SV45 is allowed to return to its central position, whereby passage of fluid under pressure to the hydraulic piston and cylinder arrangement 86' is discontinued.

It will be appreciated that since the right-hand face of the piston of the arrangement 86' has twice the area of the left-hand face thereof, and with fluid under pressure continuously applied to said left-hand face, the piston of said arrangement, and thus the piston rod, move under constant pressure in either direction according to the position of solenoid valve SV45.

I claim:

1. A fluid pressure operated system for driving the movable platen of a press against the cooperating platen comprising:

A. Two pairs of piston and cylinder means operatively connected to the movable platen on either side thereof to drive said platen into engagement with the cooperating platen;

B. A source of fluid under pressure, connected to each piston and cylinder means;

C. Valve means associated with each piston and cylinder to control the flow of pressurized fluid to said piston and cylinder, said valves being mechanically actuatable;

D. An actuating bar assembly mounted on the press for movement into and out of engagement with the mechanical actuating mechanism of the valve means; said assembly having a pair of elongated bars each being operatively engageable with the mechanical actuating mechanism of the valves which are, in turn, operatively associated with the paired piston and cylinders; and E. Drive means operatively associated with the pair of actuating bars to simultaneously move said actuating bars in tandem into engagement with the valve actuating mechanisms to cause the plurality of piston and cylinders to cooperatively drive the movable platen against the cooperating platen.

2. A fluid pressure system for driving the movable platen of a press against the cooperating platen as described in claim 1 wherein the cooperating platen is movable between operating and rest positions, and the drive means for the actuating bar assembly is energized when the cooperating platen is moved into its operating position.

3. A fluid pressure operated system for driving a movable platen of a press against the cooperating platen as described in claim 1 wherein the actuating bar drive means further comprises:

A. A single piston and cylinder;

B. A first pair of bell cranks operatively interconnected on opposite sides of the press by means of an axle, said axle being rotationally mounted on the press, one of said cranks being directly connected to the piston and cylinder to cause rotation thereof;

C. A second pair of bell cranks rotatably mounted on opposite sides of the press, and being connected for tandem movement in association with the corresponding bell crank of the first pair; and D. Linkage means connecting each pair of bell cranks to a corresponding end of an actuating bar in a manner to cause movement of said actuating bars into and out of engagement with the mechanical actuating mechanism of the valves upon the actuation of the single piston and cylinder.

* * * * *